US005778458A

United States Patent [19]

Speelman

[11] Patent Number: 5,778,458

[45] Date of Patent: Jul. 14, 1998

[54] BIODEGRADABLE AND FLUSHABLE BEDPAN LINER

[76] Inventor: Wilma Speelman, 1686 Flickinger Hill, Wooster, Ohio 44690

[21] Appl. No.: 752,789

[22] Filed: Nov. 20, 1996

Related U.S. Application Data

[63] Continuation of Ser. No. 45,431, Oct. 19, 1995, abandoned.

[51] Int. Cl.[6] ..... A61G 9/00

[52] U.S. Cl. ..... 4/452; 4/451

[58] Field of Search ..... 4/452, 451, 450, 4/457, 661, DIG. 19

[56] References Cited

U.S. PATENT DOCUMENTS

| | | | |
|---|---|---|---|
| 3,936,890 | 2/1976 | Oberstein | 4/452 |
| 4,136,798 | 1/1979 | Oberstein | 4/452 |
| 4,720,880 | 1/1988 | Barreau | 4/452 |

*Primary Examiner*—David J. Walczak
*Attorney, Agent, or Firm*—Jerry Semer

[57] ABSTRACT

The invention is basically a bedpan liner. The liner is made out of paper that is biodegradable and flushable down a toilet. The paper is cut out in a pattern that fits the bedpan. The sides of the paper are crimped upward to fit the sides on the bedpan. In use the bedpan liner is basically placed within a bedpan and placed in position under the patient so that his waste material will go into the bedpan protected by the bedpan liner. When the patient is done, the person cleaning the bedpan takes the bedpan out, walks over to the toilet, lifts the lid and toilet seat and tilts the bedpan down so that the liner with the waste will slide out of the bedpan and into the toilet. The cleaning person the flushes the toilet, which disposes of the waste and the bedpan liner. The bedpan is then washed and relined for the next use.

9 Claims, 7 Drawing Sheets

BIODEGRADABLE AND FLUSHABLE BEDPAN LINER

This application is a continuation of the application Ser. No. 29/045,431 filed Oct. 19, 1995 now abandoned.

FIELD OF THE INVENTION

The present invention relates generally to a disposable, biodegradable, and flushable bedpan liner.

BACKGROUND OF THE INVENTION

As our population gets older and as hospitals release individuals much more quickly than in the past there is much more necessity to keep bedridden patients at home or in nursing homes. The cleaning out of a bedpan is a dirty, nasty job. Thus, one of the objectives is to create a bedpan liner that makes the job of cleaning out the bedpans much easier and quicker. The features of this liner that makes the job much easier, quicker and less dirty is that the liner is made out of paper. The paper is flushable and biodegradable. One of the objectives of the invention is to create a disposable bedpan liner that can be easily disposed of and safe to the environment.

There have been several attempts to create a disposable bedpan liner. One of these can be seen in U.S. Pat. No. 4,759,086 to Boothcox. Here the bedpan liner is made out of material similar to that of a diaper so that it soaks up the bodily waste fluids. The applicant has found it unnecessary to actually soak up the bodily waste fluids since the bed pan can easily can be dumped into the toilet with her liner due to the fact that it is flushable and biodegradable. Thus the bedpan itself can keep in the fluids. The other major problem with the Boothcox liner is that once the liners have been used you must find a place to dispose of the liner. This liner can not be dumped down the toilet like applicant's liner. This liner must be thrown in the trash and cause additional problems as to trash disposal and increase of land fill problems with more waste.

O'Conner in U.S. Pat. No. 4,343,053 has also devised a disposable bedpan liner. This liner folds up into a little bag to hold the waste. However this liner has the same problems as the Boothcox liner in that the bag must be separately disposed of and can not be flushed down the toilet as applicant's liner. Secondly, this liner with its handle and everything would be much more expensive to produce. As stated above the applicant has found that it is not necessary to have liquid impervious flexible material to make the liner. Since the bedpan liner does not come out of the bedpan after its use until it is dumped down the toilet there is no necessity to make the bedpan liner out of completely impervious material since the liner is never picked up to be carried anywhere without the bedpan being involved. Another disposable liner is shown in Stewart III U.S. Pat. No. 4,882,794. Here again the disposable waste containment unit comprises a liquid impervious liner. As I pointed out above there is no necessity according to inventor for her paper liner to be completely impervious to liquids. Also as I pointed out before by making the bag impervious to liquid and not being able to be flushed down the toilet the bag must be thrown in the waste and cause landfill problems. The inventor's design is a paper liner that is biodegradable and flushable.

SUMMARY OF THE INVENTION

The invention is basically a bedpan liner. The liner is made out of paper that is biodegradable and flushable down a toilet. The paper is cut out in a pattern that fits the bedpan. The sides of the paper are crimped upward to fit the sides on the bedpan. In use the bedpan liner is basically placed within a bedpan and placed in position under the patient so that his waste material will go into the bedpan protected by the bedpan liner. When the patient is done, the person cleaning the bedpan takes the bedpan out, walks over to the toilet, lifts the lid and toilet seat and tilts the bedpan down so that the liner with the waste will slide out of the bedpan and into the toilet. The cleaning person the flushes the toilet, which disposes of the waste and the bedpan liner. The bedpan is then washed and relined for the next use.

DETAILED DESCRIPTION OF THE PREFERRED EMBODIMENT

Figure 1:
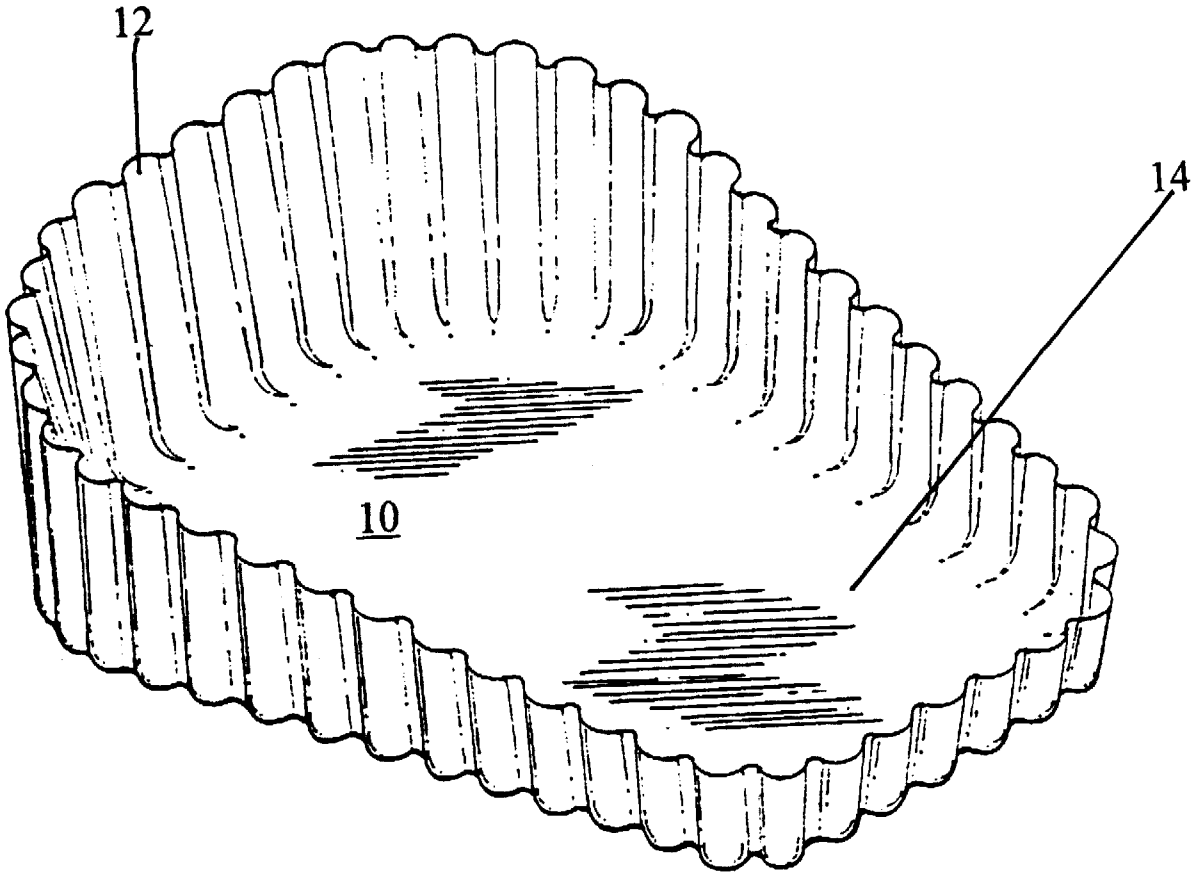
FIG. 1 is a perspective view of the bedpan liner.
Figure 2:
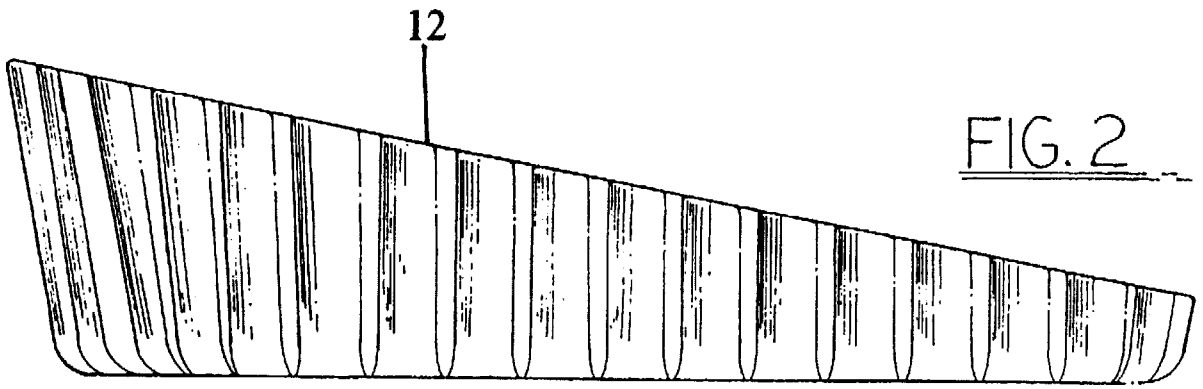
FIG. 2 is a side view of the invention.
Figure 3:
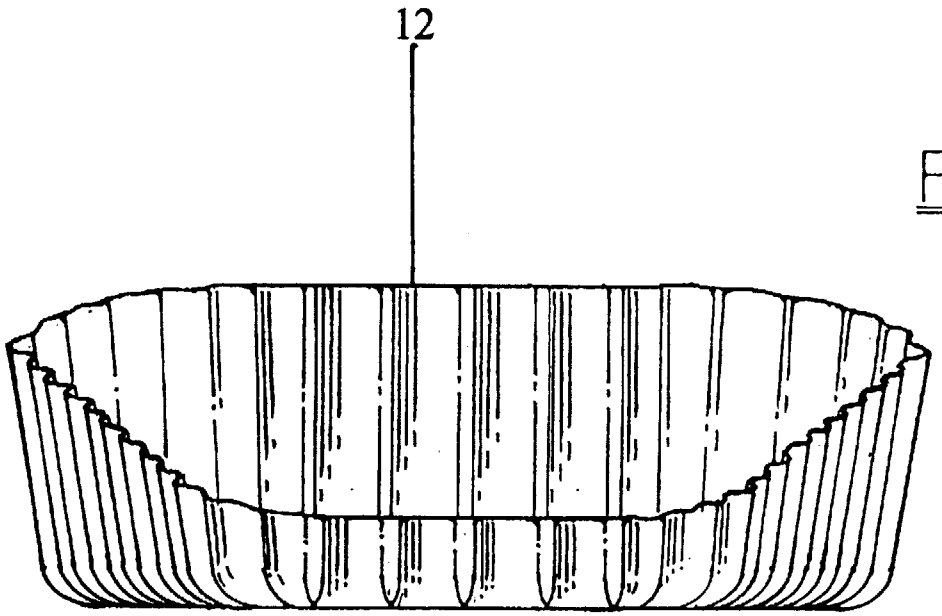
FIG. 3 is a front view of the invention.
Figure 4:
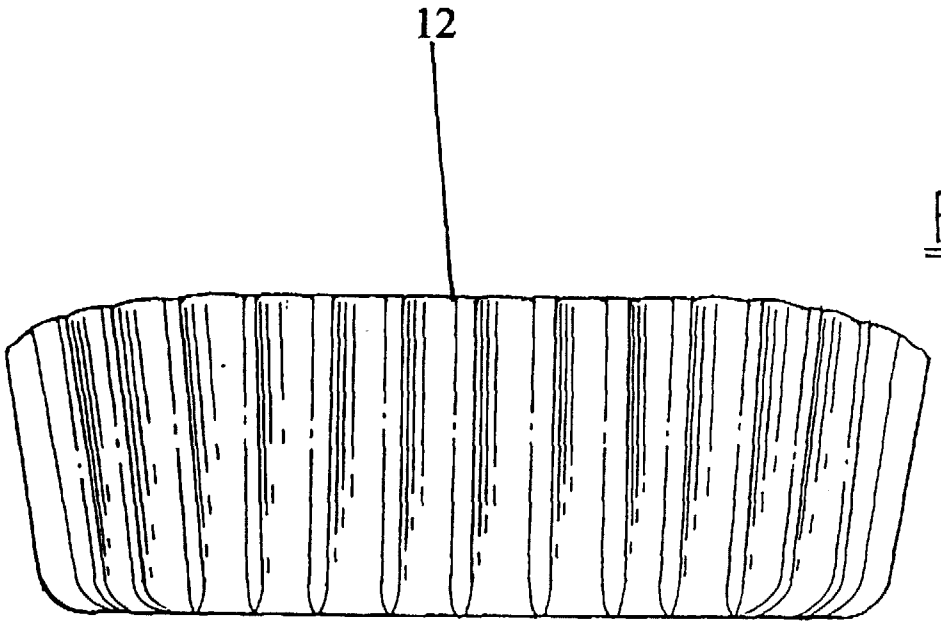
FIG. 4 is a back view of the invention.
Figure 5:
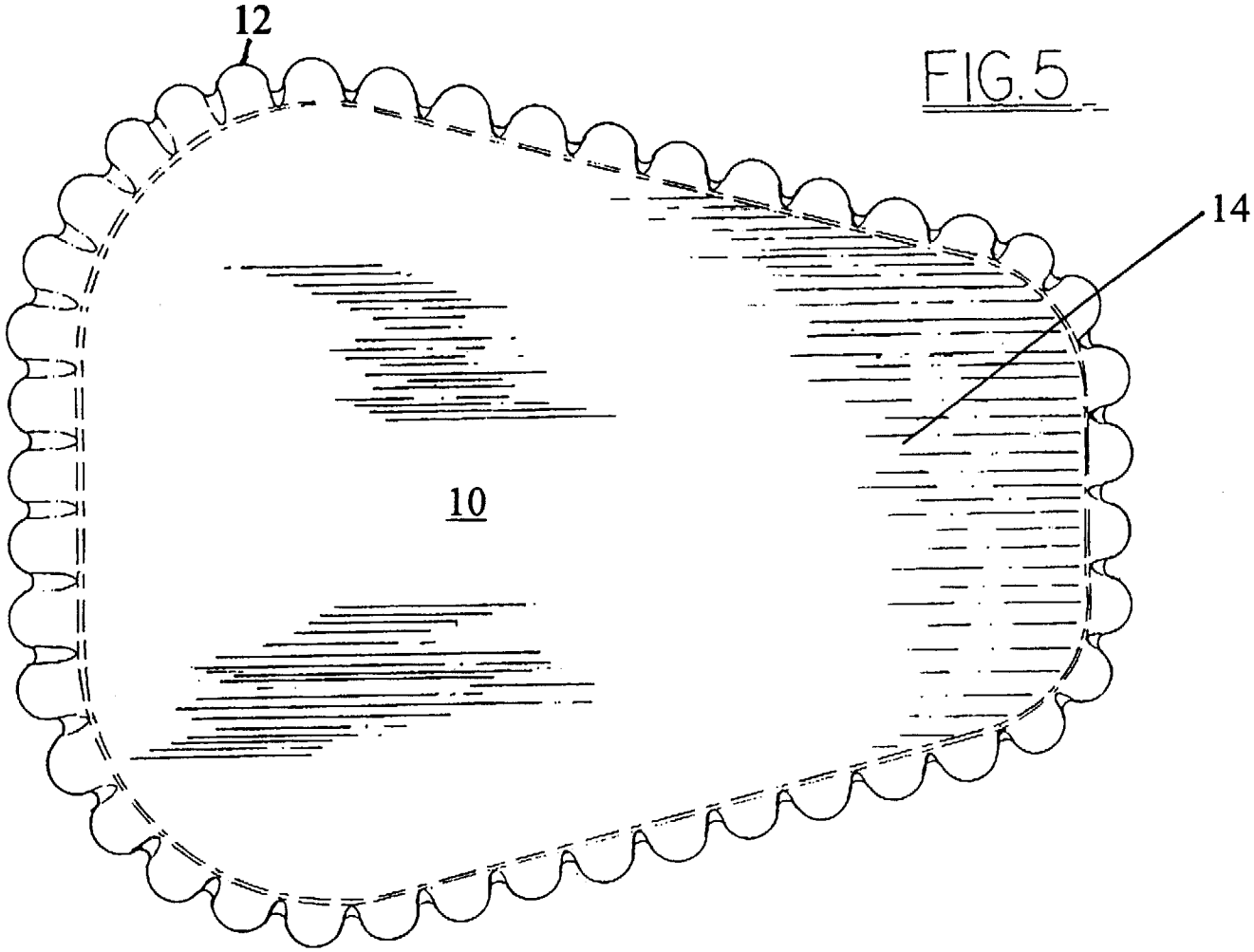
FIG. 5 is a top view of the invention.
Figure 6:
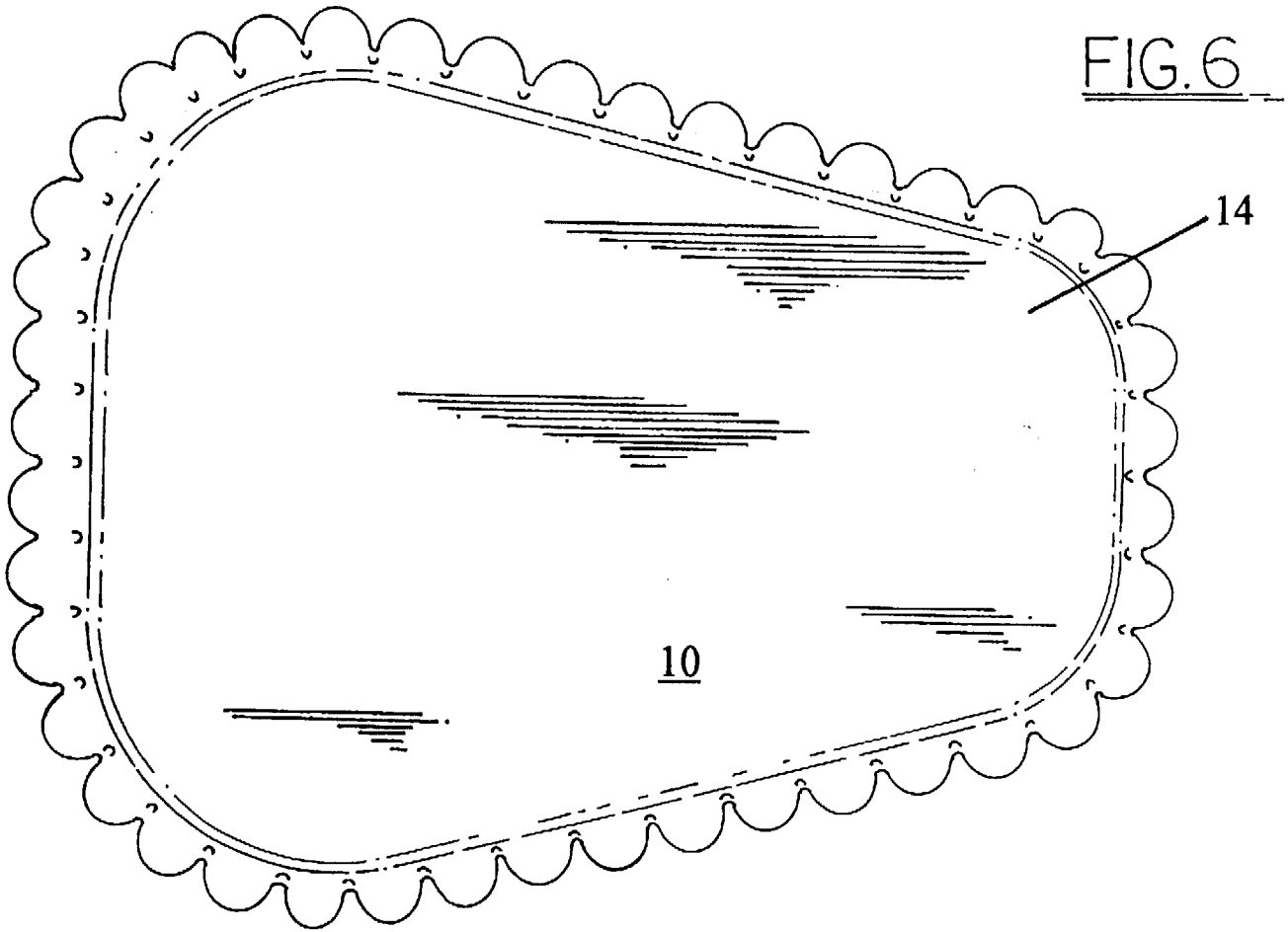
FIG. 6 is a bottom view of the invention.

FIG. 1 is a perspective view of the invention. The invention is a disposable bedpan liner 10 with crimped or pleated sides 12. The most important aspect of the bedpan liner 10 is the material out of which it is made. In the preferred embodiment the bedpan liner 10 is made out of paper which is biodegradable and flushable down a toilet. In the preferred embodiment shown in FIGS. 5 and 6 the bedpan 10 liner has a trapezoidal bottom 14. As one can see from FIGS. 2, 3 and 4 the sides 12 of the bedpan liner 10 are triangular in nature so that the front is slightly lower than the back of the bedpan liner 10. However, the bedpan liner 10 can made in several different shapes to fit the bedpan 20 used. Basically to produce the bedpan liner 10 one cuts the liner so that it fits in the bottom of the bedpan 20 and then crimps or pleats the sides so that the bedpan liner 10 will fit snugly up against the sides of the bedpan 20. Since the bedpan liner 10 is made out of paper the bedpan liner 10 can be made virtually for any shaped bedpan 20.

Figure 7:
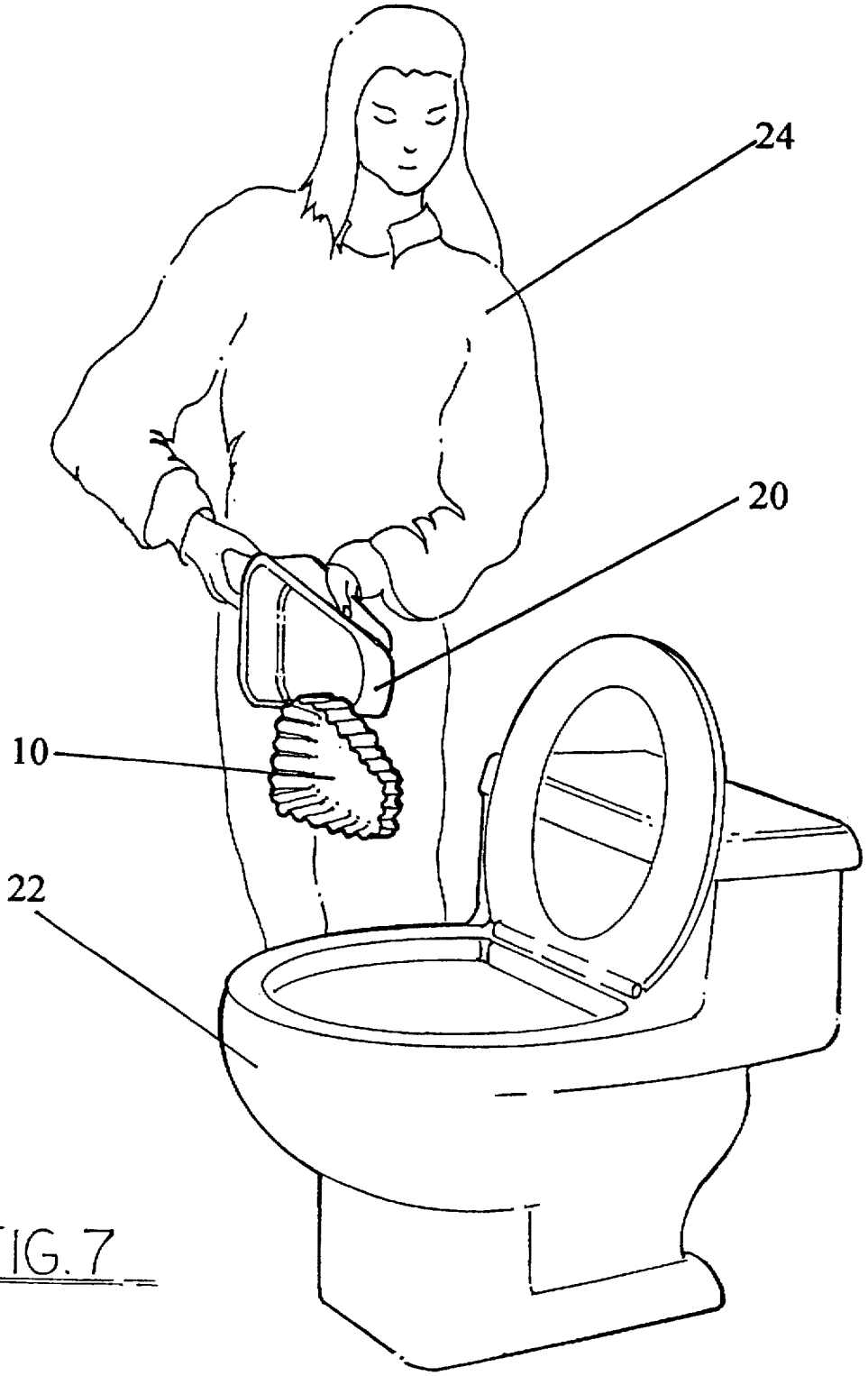
FIG. 7 is a view of the invention being disposed of in a toilet.

In use the bedpan liner 10 is placed within the bedpan 20 and the caretaker 24 of the bedridden patient places the bedpan 20 under the patient in an area to receive the waste. Once the patient has delivered his waste the caretaker 24 takes the bedpan 20 out, walks over to a toilet 22 and lifts the lid and toilet seat. As shown in FIG. 7, the caretaker 24 then tips the bedpan 20 over the toilet 22 so that the bedpan liner 10 slides out of the bedpan 20 and falls into the toilet 24. Then the caretaker 24 flushes the toilet 22 which disposes of the waste and the bedpan liner 10. As I stated before the bedpan liner 10 is made out of a material in the preferred embodiment paper that is both flushable and biodegradable. By being able to flush the bedpan liner 10 down the toilet 24 one eliminates any problems as to disposing of the wastes or the bedpan liner 10 and clearly eliminates any problems as to taking space in landfills. Then the caretaker 24 washes the bedpan and places within a new bedpan liner 10. As I stated before the bedpan liner 10 does not have to be impervious to liquids in that the bedpan liner 10 is never take out of the bedpan 20 until its over a toilet 24 and being dumped into said toilet 22.

Changes and modifications in the specificity described embodiments can be carried out without departing from the scope of the invention which is intended to limited only by the scope of the appending claims.

In the claim:

1. A disposable, flushable, and biodegradable bed pan liner comprising:

a. a bed pan liner adapted to fit within a bed pan and said liner has a planar bottom and sides that extend nearly around the outer circumference of the planar bottom and said sides are crimped nearly completely around the outer circumference of the planar bottom; and, b. said liner is made out of disposable, flushable, and biodegradable material.

2. A disposable, flushable, and biodegradable bed pan liner as in claim 1 wherein:

a. the material for making the bed pan liner is paper that is flushable and biodegradable.

3. A bed pan liner as in claim 2 wherein:

a. the liner has sides that are nearly perpendicular to the planar bottom.

4. A method for using and cleaning a bed pan with a liner consisting essentially of:

a. placing a liner in a bed pan and said liner has a planar bottom and sides that extend around the outer circumference of the planar bottom and said sides are crimped nearly completely around the outer circumference of the planar bottom; and, b. placing the bed pan with liner in position under the patient; and, c. removing the bed pan with liner after the wastes have been dumped into the bed pan by the patient; and, d. taking the bed pan to the toilet; and, e. tilting the bed pan so that the liner and wastes will slide into the toilet bowl; and, f. flushing the toilet; and, g. washing the bed pan.

5. A method for using and cleaning a bed with a liner as in claim 4 wherein;

a. the liner is made out of material that is disposable, flushable, and biodegradable.

6. A method for using and cleaning a bedpan with a liner as in claim 5 wherein: the liner is made out of flushable and biodegradable paper.

7. A method for using and cleaning a bed pan liner as in claim 6 wherein:

a. the liner has sides that are nearly perpendicular to the planar bottom.

8. A method for using and cleaning a bed pan with a liner as in claim 4 wherein:

a. the liner has sides that are nearly perpendicular to the planar bottom.

9. A bed pan liner as in claim 1 wherein:

a. the liner has sides that are nearly perpendicular to the planar bottom.

* * * * *